US012295406B1

(12) United States Patent
Malhi

(10) Patent No.: US 12,295,406 B1
(45) Date of Patent: May 13, 2025

(54) ROLLING TRAY

(71) Applicant: Anil Malhi, Riverside, CA (US)

(72) Inventor: Anil Malhi, Riverside, CA (US)

( * ) Notice: Subject to any disclaimer, the term of this patent is extended or adjusted under 35 U.S.C. 154(b) by 180 days.

(21) Appl. No.: 17/335,678

(22) Filed: Jun. 1, 2021

(51) Int. Cl.
*A24C 5/44* (2006.01)

(52) U.S. Cl.
CPC ..... *A24C 5/44* (2013.01)

(58) Field of Classification Search
None
See application file for complete search history.

(56) References Cited

U.S. PATENT DOCUMENTS

| | | | | |
|---|---|---|---|---|
| D737,509 | S | 8/2015 | Now | |
| 2013/0160778 | A1 | 6/2013 | Magnone | |
| 2016/0081390 | A1 | 3/2016 | Ackerman | |
| 2019/0150501 | A1* | 5/2019 | Duffy | F23Q 2/50 |
| 2019/0328037 | A1* | 10/2019 | Kesselman | A24D 1/022 |
| 2020/0236988 | A1* | 7/2020 | Jarrett | A24C 5/44 |

* cited by examiner

*Primary Examiner* — Phu H Nguyen
(74) *Attorney, Agent, or Firm* — Kenneth L. Tolar

(57) ABSTRACT

A rolling tray includes a substantially planar sheet having an upper surface, a lower surface, and a continuous, upstanding peripheral wall for corralling errant herbs and smoking materials. On the upper surface of the sheet are a plurality of compartments for retaining various smoking accessories adjacent a rolling surface, such as tools, personal items, lighters, rolling papers, a manual rolling machine, and a spool of smoker's wick.

14 Claims, 1 Drawing Sheet

ROLLING TRAY

CROSS REFERENCE TO RELATED APPLICATIONS

None.

BACKGROUND OF THE INVENTION

The present invention relates to a uniquely designed rolling tray having a plurality of compartments for retaining smoker's tools and accessories.

DESCRIPTION OF THE PRIOR ART

A rolling tray is a convenient smoker's tool for those who prefer to roll their own cigarettes, cigars, and similar smoking articles. Rolling trays provide a sanitary surface on which to grind and roll herbs and which prevent errant materials from being scattered about a surrounding area. Furthermore, the tray corrals any residue that falls during the rolling process or when a grinder is emptied, which significantly expedites cleaning of the area once the smoker has finished.

Most rolling trays include a planar sheet that provides a rolling surface with upstanding peripheral walls for containing errant herb residue. Certain rolling trays sometimes include a slot or compartment for retaining rolling papers and herbs. However, when rolling one's own smoking articles, a smoker often needs additional tools, such as grinders, a rolling machine, clips, cone-paper tools, and lighters. Because conventional rolling trays are not designed to accommodate such items, they are either placed on the tray where they obstruct the rolling process or are positioned adjacent the tray where they clutter a surrounding area.

Accordingly, there is currently a need for a rolling tray that eliminates the clutter and obstruction caused by smoking accessories when rolling a smoking article. A review of the prior art reveals a few trays for assisting smokers with rolling cigarettes and cigars. For example, U.S. patent publication no. 2016/0081390 to Ackerman discloses a utility case for smoking tools including a housing having a planar upper surface for rolling smoking articles and an interior drawer for storing tools.

British patent no. GB 2522274 to Chaisty discloses a device for assisting a user with rolling a cigarette.

U.S. Pat. No. D737,509 to Now discloses an ornamental design for a rolling tray comprising a planar tray with a pair of contiguous compartments.

Although rolling trays exist, none are configured to house a myriad of smoker's tools adjacent a rolling surface. The device of Ackerman requires a user to remove a drawer in order to access stored tools. Once the tools are accessible, they still must be positioned near the rolling surface where they clutter the surrounding area. The device does not allow a multitude of tools and accessories to be conveniently retained and stored adjacent a rolling surface.

The present invention overcomes the disadvantages of the prior art by providing a uniquely designed tray having a multitude of compartments specifically configured to firmly retain select tools. Furthermore, the tray includes a compartment dimensioned and configured to retain a rolling machine that significantly expedites the rolling process without cluttering a surrounding area.

SUMMARY OF THE INVENTION

The present invention relates to a rolling tray comprising a substantially planar sheet having an upper surface, a lower surface, and a continuous, upstanding peripheral wall for corralling errant herbs and smoking materials. On the upper surface of the sheet are a plurality of compartments for retaining various smoking accessories adjacent a rolling surface, such as tools, personal items, lighters, rolling papers, a manual rolling machine, and a spool of smoker's wick.

It is therefore an object of the present invention to provide a rolling tray that conveniently accommodates and retains multiple smoker's accessories immediately adjacent a rolling surface.

It is therefore another object of the present invention to provide a rolling tray having an integral herb grinder.

It is yet another object of the present invention to provide a rolling tray configured to conveniently retain a manual rolling machine adjacent a rolling surface.

Other objects, features, and advantages of the present invention will become readily apparent from the following detailed description of the preferred embodiment when considered with the attached drawings and the appended claims.

DESCRIPTION OF THE PREFERRED EMBODIMENT

Figures 1, 2:
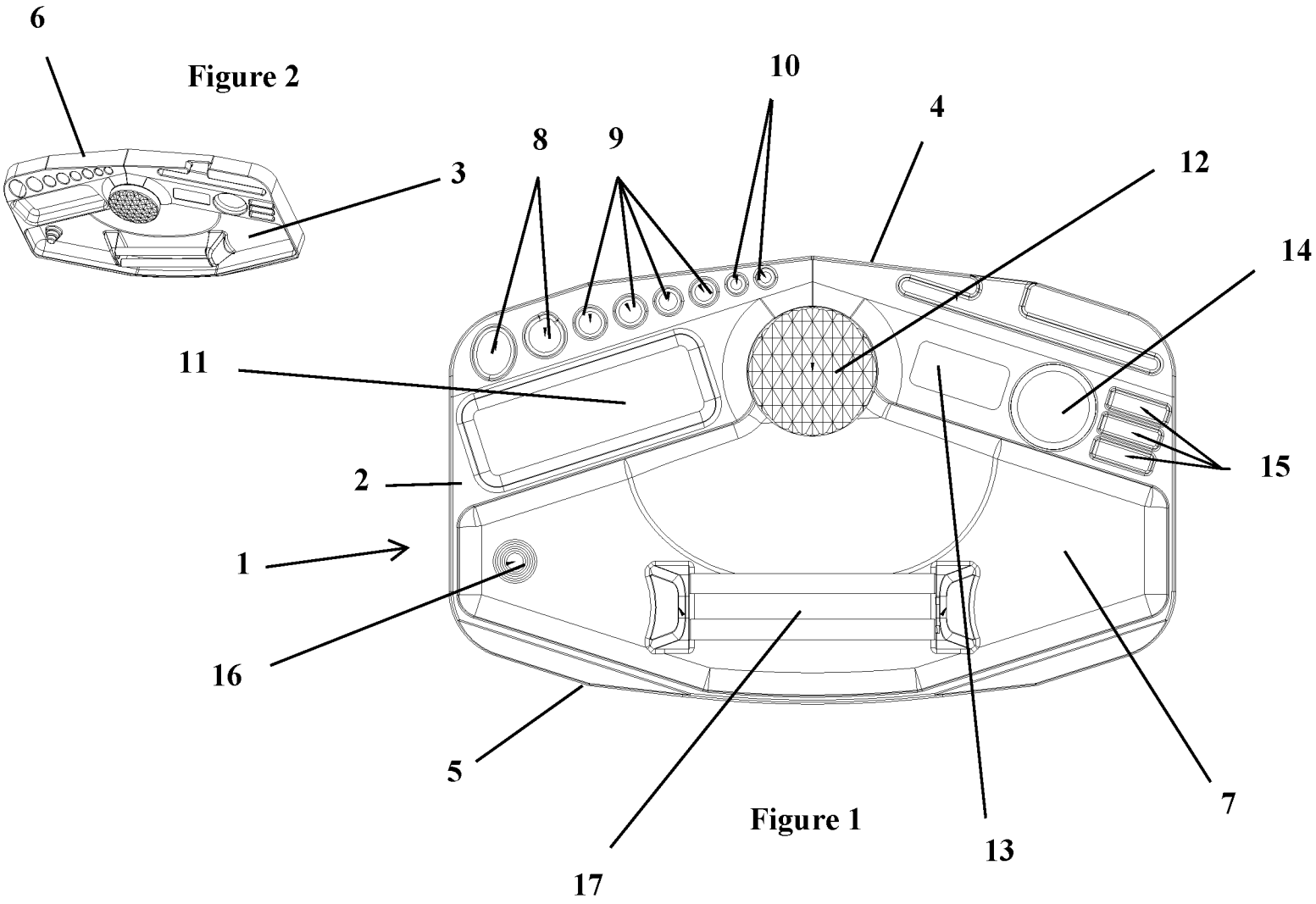
FIG. 1 is a top, plan view of the rolling tray according to the present invention.
FIG. 2 is a lower, perspective view of the rolling tray.

The present invention relates to a rolling tray comprising a substantially planar sheet 1 having an upper surface 2, a lower surface 3, an upper edge 4, a lower edge 5, two opposing side edges and a continuous upstanding peripheral wall 6 for corralling errant herbs and smoking materials. On the upper surface of the sheet are a plurality of compartments for retaining various smoking accessories, tools, and personal items. For example, a larger polygonal depression 7 is formed on a lower segment of the sheet that provides a rolling surface and a general work area for the user. Adjacent the upper edge are a series of circular cavities, each dimensioned and configured to firmly retain a specific tool. Some cavities 8 could be configured to retain certain lighter models while adjacent cavities 9 are configured to retain tools, such as cutters or pokers. A smaller set 10 of circular cavities are dimensioned to retain cone papers or associated tools.

Between the circular cavities and the work surface is a rectangular compartment 11 for housing herbs and smoking tips. Adjacent the herb compartment 11 is a recessed grinding pad 12 including a panel having a plurality of pointed teeth, serrations, tines, or pegs that fracture herb leaves when reciprocated or pressed against the panel.

Adjacent the grinder 12 is an indention 13 for receiving a logo placard or a similar advertising medium. A circular pillbox 14 near the logo placard can secure medications and other similar personal items. Between the pillbox 14 and a side edge of the tray are a plurality of parallel slots 15 for housing rolling papers.

Some smokers prefer to ignite a smoking article using a smoker's wick to avoid inhaling harmful gases emanating from a butane lighter. A wick also remains lit for a longer duration than most lighters. Near the opposing side edge of the sheet, within the work surface depression 7, is a spindle 16 around which a spool of smoker's wick can be wrapped to assist a user with igniting a smoking article.

Certain manual rolling machines, such as the type marketed and sold under the trademark HONEYPUFF™, typically include a bottom wall having a pair of spaced upstanding sidewalls vertically extending therefrom. Positioned between the two sidewalls are a pair of rollers and a conveyor surface for rolling tobacco and a rolling paper into a tubular formation. An actuator on one of the sidewalls moves the rollers between an open and closed position. Proximal the lower edge of the tray is wide-profile chamber 17 having oblique sidewalls for uprightly supporting the manual rolling machine described above.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A rolling tray comprising:

a substantially planar sheet having an upper surface, a lower surface, and a continuous upstanding peripheral wall for corralling errant herbs and smoking materials;

a polygonal depression formed on the upper surface of said sheet that provides a rolling and a work surface for the user;

a plurality of circular cavities on the upper surface of said sheet for retaining smoker's tools, wherein a predetermined number of said circular cavities are dimensioned and configured to firmly retain a predetermined style of lighter;

a recessed grinding pad on the upper surface of said sheet, said grinding pad including a panel having a plurality of fracturing members thereon.

2. The rolling tray according to claim 1 wherein a predetermined number of said circular cavities are dimensioned and configured to retain cone papers.

3. The rolling tray according to claim 1 further comprising a circular pillbox on the upper surface of said sheet for securing medications and personal items.

4. The rolling tray according to claim 1 further comprising a plurality of parallel slots on the upper surface of said sheet for housing rolling papers.

5. The rolling tray according to claim 1 further comprising a spindle on the upper surface of said sheet around which a spool of smoker's wick is wrapped to assist a user with igniting a smoking article.

6. The rolling tray according to claim 1 further comprising:

a wide-profile chamber on said sheet;

a rolling machine positioned within said wide-profile chamber.

7. The rolling tray according to claim 1 wherein the panel of said grinding pad includes a plurality of pointed teeth, serrations, or pegs on an upper surface that fracture leaves when pressed against the panel.

8. A rolling tray comprising:

a substantially planar sheet having an upper surface, a lower surface, and a continuous upstanding peripheral wall for corralling errant herbs and smoking materials;

a polygonal depression formed on the upper surface of said sheet that provides a rolling and a work surface for a user;

a plurality of circular cavities on the upper surface of said sheet for retaining smoker's tools, wherein a predetermined number of said circular cavities are dimensioned and configured to firmly retain a predetermined style of lighter, and wherein a second predetermined number of said circular cavities are dimensioned and configured to retain cone papers;

a recessed grinding pad on the upper surface of said sheet, said grinding pad including a panel having a plurality of fracturing members thereon.

9. The rolling tray according to claim 8 further comprising a circular pillbox on the upper surface of said sheet for securing medications and personal items.

10. The rolling tray according to claim 9 further comprising a plurality of parallel slots on the upper surface of said sheet for housing rolling papers.

11. The rolling tray according to claim 10 further comprising a spindle received within said polygonal depression around which a spool of smoker's wick is wrapped to assist a user with igniting a smoking article.

12. The rolling tray according to claim 11 further comprising:

a wide-profile chamber on said sheet;

a rolling machine positioned within said wide-profile chamber.

13. The rolling tray according to claim 8 wherein said griding pad includes a panel having a plurality of pointed teeth, serrations, or pegs on an upper surface that fracture leaves when pressed against the panel.

14. The rolling tray according to claim 13 wherein said chamber includes oblique sidewalls for uprightly supporting a particular type of rolling machine.

* * * * *